US006506971B1

(12) United States Patent
Grach et al.

(10) Patent No.: US 6,506,971 B1
(45) Date of Patent: Jan. 14, 2003

(54) ELECTRIC CABLE WITH LOW EXTERNAL MAGNETIC FIELD AND METHOD FOR DESIGNING SAME

(75) Inventors: Yosef Grach, Haifa (IL); Michael Erlitzki, Haifa (IL)

(73) Assignee: The Israel Electric Corporation, Ltd., Haifa (IL)

( * ) Notice: Subject to any disclaimer, the term of this patent is extended or adjusted under 35 U.S.C. 154(b) by 0 days.

(21) Appl. No.: 09/743,356

(22) PCT Filed: Mar. 24, 1999

(86) PCT No.: PCT/IL99/00167

§ 371 (c)(1),
(2), (4) Date: Nov. 5, 2001

(87) PCT Pub. No.: WO00/00989

PCT Pub. Date: Jan. 6, 2000

(30) Foreign Application Priority Data

Jun. 30, 1998 (IL) ..... 125144

(51) Int. Cl.[7] ..... H01B 7/00
(52) U.S. Cl. ..... 174/32; 174/34
(58) Field of Search ..... 174/32, 34, 36, 174/113 R; 333/12, 142

(56) References Cited

U.S. PATENT DOCUMENTS 3,675,042 A 7/1972 Merriam

FOREIGN PATENT DOCUMENTS

| | | |
|---|---|---|
| GB | 2 059 670 A | 4/1981 |
| RU | 2025014 C1 | 12/1994 |
| SU | 1836766 A3 | 10/1990 |

OTHER PUBLICATIONS

Hagel et al. "On the Magnetic field of an Infinitely Long Helical Line Current," IEEE Transactions on Magnetics, (Jan., 1994), pp. 80–84, vol. 30, No. 1.

Alksne. "Magnetic Fields Near Twisted Wires," IEEE Transactions on Space Electronics and Telemetry, (Dec., 1964), pp. 155–158.

Shenfeld. "Magnetic Fields of Twisted–Wire Pairs," IEEE Transactions on Electromagnetic Compatibility, (Nov., 1969), pp. 164–169, vol. EMC–11, No. 4.

*Primary Examiner*—Chau N. Nguyen
(74) *Attorney, Agent, or Firm*—Browdy and Neimark

(57) ABSTRACT

A method of designing a single- or a multi-phase electric cable for conducting current through insulated conductors and creating a weak external magnetic field, so as to obtain a cable wherein at least one of the above-mentioned conductors is assembled from two or more insulated sub-conductors connected in parallel, and wherein the sum of cross-sectional areas of the sub-conductors is equal to a design cross-sectional area of the conductor. The arrangement in the cable is such that each of the sub-conductors is adjacent to a conductor or a sub-conductor associated with either a different phase or a different current direction, and the sum of magnetic moments of magnetic dipoles formed from all currents passing through the cable is zero.

21 Claims, 5 Drawing Sheets

ELECTRIC CABLE WITH LOW EXTERNAL MAGNETIC FIELD AND METHOD FOR DESIGNING SAME

FIELD OF THE INVENTION

This invention relates to a method of designing multi-conductor electric cables (both single-phase and multi-phase) which create a very weak external magnetic field, and to the structure of such cables per se.

BACKGROUND OF THE INVENTION

Scientific research and investigation of influence of continuous exposure to existing environmental alternating electromagnetic field, which have been completed to date, have arrived at very significant conclusions. For example, it has been acknowledged that epidemiological evidence points to human health hazards in exposure to ambient alternating electromagnetic field environments exceeding 0.2 $\mu$T. A dose-dependence of childhood leukemia is suggested for power frequency fields in the range 0.2–0.4 $\mu$T. Assessment of the ambient magnetic environment in these studies at sites near power transmission and distribution lines has generally not taken account of much higher but more focal fields in the immediate vicinity of operating devices in the home and workplace. Resulting risk estimates may thus underestimate the true exposure levels from all sources. Although largely neglected in the emphasis on magnetic field bio-effects, there is also a body of laboratory evidence relating biologically significant effects, particularly in cerebral tissue calcium binding, to electric field exposures in the range 10–100 V/m. It must be emphasized that epidemiological studies do not rule out effects of electromagnetic fields on cancer risk, even large ones. This is because of limitations in exposure assessment and undoubted misclassification of exposure, as well as the absence of truly unexposed subjects.

The Regulations of the Israeli Electricity Law stipulate in Section 31 that, at medical sites where bio-potential measurements are provided (such as emergency departments in hospitals, ECG or EMG laboratories or the like) electric cables are to be screened to avoid or diminish interference caused by electrical equipment. Section 31 of the Regulations states that in such locations the maximal allowed value of magnetic induction be $2 * 10^{-7}$ to $4 * 10^{-7}$ T (i.e. 2 to 4 mGs).

Screens which are utilized for protection from the excessive magnetic field are usually capable of reducing external magnetic field intensity by about 10–30%. Such a screen is effective for protecting the cable from ambient magnetic fields, but it decreases only slightly the external magnetic field created by the electric cable itself.

It should be mentioned that an electromagnetic field created in the vicinity of a current conducting cable may have a harmful effect on precise electronic instruments, computers and communication devices. In the prior art, attempts have been made to improve transmission capability of a multi-wired electrical conductor by reducing its coefficient of additional losses.

RU 2025014 describes a three-phase current cable for supply of electric energy users in three-phase circuits with frequency up to 10 kHz. The cable contains phase current conductors (for example, A,B,C), wherein each of the current conductors is in the form of a pair of parallel connected wires. The pairs of wires A,B,C are placed opposite to each other relative to the center of the conductor.

SU 1836766 discloses an electricity supply system, having three-phase current conductors with phases made in the form of parallel connected wires set symmetrically relative to a central wire. As explained in the patent specification, when a three-phase current passes through the current conductors, two equal oppositely directed magnetic fluxes are formed and smaller counter EMF's (electromotive forces) are induced in the cable; the inductive resistance is thereby reduced together with the coefficient of additional losses. The system is declared to have an increased transmission capability.

It should be emphasized, that both of the above-mentioned technical solutions are focussed on achieving a minimal internal magnetic interaction in the multi-phase conductor for improving its transmission capability, and the goal is gained by providing a symmetrical structure of parallel connected wires of different phases.

U.S. Pat. No. 3,675,042 (Merriam) entitled "Apparatus for power transmission utilizing superconductive elements", discloses a long electrical power transmission line utilizing superconductivity in which each conductor includes a superconductive portion and a normally conductive portion having high thermal conductivity with the two portions being in electrical and thermal contact along substantially their entire lengths. The conductors are in the shape of thin wires to provide a low internal magnetic field and permit high current densities. The conductors are connected in pairs into a plurality of direct current circuits which in turn are connected to one another in parallel and are arranged in a plurality of circular clusters to further minimize the internal magnetic field and which may be selectively connected between a power source and one or more loads.

In such an arrangement, the conductor material operates at or near zero degrees absolute. As the conductor radius increases, for constant current density, the magnetic flux density increases linearly in accordance with the equation:

$$B = \frac{I}{2\pi r} \cdot \mu$$

where:

B=magnetic flux density r=radius of conductor $\mu$=magnetic permeability

I=conductor current j=current density

There thus exists a critical magnetic flux density for superconductive material, beyond which the material ceases to superconduct. For this reason, as described at col. 6, lines 70ff and recited in the claims, the diameter of the conductor must be limited to no more than about 2 mm.

Each superconductive core is surrounded by copper cladding to quench fire if core loses superconductivity and gives rise to heating of the core. Thus, the actual distance of adjacent cores is significantly increased by the diameter of the copper cladding, leading to an increased external magnetic field.

U.S. Pat. No. 3,675,042 is thus directed to minimizing the internal magnetic flux density without regard to the external magnetic field. In contrast thereto, the invention is directed to minimizing the external magnetic field.

British Patent Publication No. 2 059 670 describes a high voltage cable for a three-phase power supply system, comprising six phase conductors each of the same cross-sectional area arranged symmetrically around a central null or protective conductor. The phase conductors are connected together in oppositely-situated pairs at their ends. GB 2 059

670 has as an objective the requirement to obtain voltage symmetry at the end of the cable and to limit the losses in a 3-phase line at higher frequencies. No suggestion is made to reduce the external magnetic field.

SUMMARY OF THE INVENTION

It is the two-fold object of the present invention to provide a method for designing a single-phase or a multi-phase electric cable having a very weak external magnetic field and, correspondingly, to provide a novel structure of such cables.

According to one aspect of the invention, the above object can be achieved by a method of designing a single- or multi-phase electric cable capable of conducting current through insulated conductors and creating a weak external magnetic field, the method comprising the following steps:

(a) assembling at least one of said conductors from two or more insulated sub-conductors to be connected in parallel, wherein the sum of cross-sectional areas of the sub-conductors is equal to a design cross-sectional area of said conductor, and wherein the sum of currents to pass through the sub-conductors is equal to a given current to pass through said conductor;

(b) arranging said conductors in the cable in such a manner that each of said sub-conductors is adjacent to a conductor or a sub-conductor associated with either a different phase or a different current direction; and (c) ensuring a predetermined minimal strength of the external magnetic field by checking the following condition for the sum of magnetic moments:

$$\sum_{i=1}^{N} \overline{M}_i = 0$$

where N is a total number of the magnetic dipoles, and i is a number of a particular dipole.

The insulated sub-conductors may have cross-sections of a circular, rectangular or any other shape.

Needless to say, that according to the Kirchhoff's Law the sum of all currents passing through all conductors and sub-conductors of the cable must be equal to zero. It is understood to those skilled in the art that the cable should be designed according to its operational conditions.

Preferably, the sub-conductors and conductors assembled and arranged according to the above definition should be placed in the cable as close as possible to one another. It is readily understood that technical limitations will be imposed by the design voltage, by quality and thickness of the electrical insulation, as well as by the cross-section of the wire.

As an option, the method may also comprise a step of twisting the arranged conductors in the cable.

A specific calculation step can be applied to the above method for ensuring that the above-described configuration provides a predetermined minimal strength of an external magnetic field.

For single-phase cables the calculation step includes arranging a number of so-called magnetic dipoles from currents passing via the mentioned sub-conductors and conductors, dividing the dipoles into groups, determining a value and direction of magnetic moment of each of said groups, and adjusting the arrangement of said conductors and sub-conductors in such a manner that the sum of magnetic moments of component dipoles in each of said groups is substantially zero.

In order to better understand the principle of the proposed approach, the following terms will be acknowledged herein below:

A dipole is a pair of currents having equal values and opposite directions and passing via a pair of adjacent wires (whether being a non-divided conductor and a sub-conductor, or two sub-conductors) in the cable.

A magnetic moment M of a dipole is a vector which can be defined as follows:

$$\overline{M} = \mu_0 * \dot{I} * D * l_0 * \overline{n}_0,$$

where:

$\mu_0$ is the magnetic permeability of vacuum,

I is the value of one of the equal and opposite currents in the dipole, $\dot{I}$ indicates the phase of alternating current D is the distance between the parallel wires in the dipole, $l_0$ is an elementary length of the wire being one unit of length, $\overline{n_0}$ is an elementary vector being perpendicular to the surface where the elementary lengths of two wires of the dipole are located; the vector $n_0$ can be carried in parallel to itself, its direction thus defined according to the right gimlet rule.

Using the above definitions, the following condition of designing a single-phase cable with a plurality of sub-conductors can be written down:

$$\sum_{i=1}^{N} \overline{M}_i = 0$$

(where N is a total number of the dipoles, and i is a number of a particular dipole).

It has been found by the inventor, that even a pair of dipoles arranged in the cable according to the above described rules enables to achieve a significant reduction of the external magnetic field. The greater the total number of sub-conductors (or the greater the number of the formed pairs of dipoles in the formed multidipole), the weaker will be the external magnetic field created at any predetermined distance from the cable. It has been found that the larger the number of parallel wires and the smaller the distance therebetween, the higher is the degree of attenuation of the external magnetic field. In a case of an infinite number of wires spatially mixed in the cable, no external magnetic field would be created, like in the case of a coaxial electric cable.

Moreover, the longer the distance from the center of the cable, the sharper will be the character of attenuation of the external magnetic field.

In other words, the method comprises the step of adjusting the degree of attenuation of the external magnetic field by selecting a number of sub-conductors for assembling said conductors of the cable.

For example, by applying the above mentioned method to a single-phase cable, one may obtain a degree of attenuation of the magnetic field of many hundreds or thousands, or even more at an exemplary distance of 50 cm from the center of the cable (!), (compared to a very weak attenuation of about 10 to 30% which can be reached by screening of equivalent conventional cables).

For multiphase cables the additional calculation step may include calculating a resulting magnetic field created by all conductors and sub-conductors in the cable and adjusting a number, cross-section and configuration of the subconductors in the cable to obtain maximal decrease of an external magnetic field in the vicinity of the cable. In such a case, the magnetic flux density in the center of the cable is usually essentially equal to zero, which factor might be helpful for correct designing of the inventive cable.

In terms of magnetic moments, the calculation step may comprise determining magnetic dipoles formed in each phase conductor of the multiphase cable and a neutral wire, and arranging the dipoles to satisfy a system of equations wherein each of said equations is built for a specific phase conductor of the cable:

$$\sum_{n=1}^{N} \overline{M}_{Rn} = 0;$$

$$\sum_{P=1}^{P} \overline{M}_{sp} = 0,$$

$$\ldots$$

$$\sum_{q=1}^{Q} \overline{M}_{Tq} = 0, \text{ where:}$$

RS, . . . T—symbolize conductors of different phases of a multiphase cable;

N, P, . . . Q—symbolize total numbers of sub-conductors in each of the phase conductors R, S, . . . T, respectively;

n, p, . . . q—each symbolize a specific number of a sub-conductor in the phase conductors R, S, . . . T respectively;

$\overline{M}_{Tq}$—symbolizes a particular magnetic moment created by a current passing in a sub-conductor q of the phase conductor T and a corresponding part of the current in the neutral conductor, when present, or in another phase when no neutral conductor is present.

The preferred version of the method for designing the multiphase cable includes the step of assembling each of m single-phase conductors of the cable from n equal sub-conductors, and the step of arranging said sub-conductors in a circle so that an angle $\alpha$ between each two sub-conductors is about 360°/m·n, and an angle $\beta$ between each two sub-conductors belonging to the same phase is about 360°/n.

The degree of attenuation of the magnetic field which can be achieved by applying the method to multi-phase cables depends on the construction of a specific cable (number of sub-conductors, their arrangement, etc.); if required, the degree may reach hundreds or thousands. It is understood, however, that complexity of the cable's construction will put a certain limitation to the maximal decrease of the external magnetic field.

It is known to those skilled in the art that the stronger the external electromagnetic field created by a cable, the easier the penetration of any ambient electromagnetic field into the cable, thereby creating electric disturbances therein, jamming in transmission lines, etc. It can now be seen, that if the magnetic field around the inventive cable can be minimized, the cable will be less sensitive to any external magnetic field. Such a property is of special importance for sensitive electronic devices (such as precise measurement instruments, computers, TV-sets, etc) and for all high frequency electronic devices. A value of mutual inductance between a reference cable and a cable of interest may serve as a measure of sensitivity of the cable of interest to external magnetic field disturbances.

Calculations and measurements which have been undertaken by the inventors, has proven that the mutual inductance of any modification of the inventive cable is much smaller than that of an appropriate conventional cable, and that the inventive cables are significantly less sensitive to external magnetic fields. The inventive cables also have smaller self-inductance than the conventional cables, thus the voltage drop along a transmission line formed by the inventive cables will be decreased.

According to a second aspect of the invention, there is provided a single-phase or a multi-phase electric cable for conducting current through insulated conductors and creating a weak external magnetic field, wherein:

at least one of said conductors is assembled from two or more insulated sub-conductors to be connected in parallel, wherein the sum of cross-sectional areas of the sub-conductors is equal to a design cross-sectional area of said conductor, and wherein the sum of currents to pass through the sub-conductors is equal to a given current to pass through said conductor;

the arrangement being such that each of said sub-conductors is adjacent to a conductor or a sub-conductor associated with either a different phase or a different current direction.

It is understood that the arrangement wherein the conductor(s) and sub-conductors (or the sub-conductors only) are placed in the cable as close as possible to one another, is preferable.

It should be emphasized, that the present invention does not impose on the sub-conductors any requirements of symmetry, equal cross-sections or specifically stated distances therebetween.

With respect to multi-phase cables, the invention also allows that at least one phase conductor in the cable is not assembled from sub-conductors.

According to one embodiment of a single-phase cable without a neutral wire, one conductor thereof is assembled from two sub-conductors which are symmetrically placed near the other (non-split) conductor from its two diametrically opposite sides.

In accordance with an alternative embodiment of the single-phase cable, each of the two conductors thereof comprises two or more sub-conductors to be connected in parallel to each other.

In the preferred embodiment of a multiphase cable, each of its m phase conductors may be assembled from n equal sub-conductors, and the sub-conductors are arranged in a circle so that an angle $\alpha$ between each two adjacent sub-conductors is 360°/m*n, and an angle $\beta$ between each two sub-conductors belonging to the same phase is 360°/n.

The multi-phase cable, according to one specific embodiment of the invention, may comprise a number of phase conductors each being assembled from two or more insulated sub-conductors being equal or non-equal in cross-section; said sub-conductors being mixed in the cable in a manner providing for a minimal external magnetic field.

It is known, that in the case of a symmetric load of a multiphase cable, current in the zero-wire (neutral wire) is absent. In this case, position of the zero-wire in the cable is not important. However, for cases where a multiphase cable is loaded non-symmetrically, it is preferable that the zero-wire is positioned in the center of the cable. It has been noticed that the inventive construction of the cable is especially helpful for reducing external magnetic fields created around such non-symmetrically loaded multiphase cables.

BRIEF DESCRIPTION OF THE DRAWINGS

In order to understand the invention and to see how it may be carried out in practice, preferred embodiments will now be described, by way of non-limiting examples only, with reference to the accompanying drawings in which.

DETAILED DESCRIPTION OF PREFERRED EMBODIMENTS

Figure 1A:
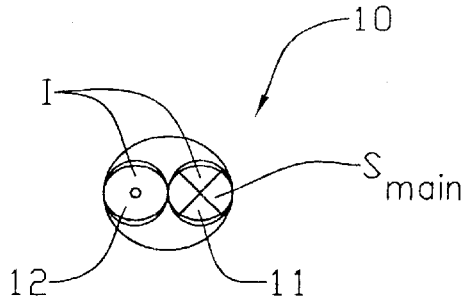
FIG. 1A PRIOR ART
FIG. 1*a* (prior art) is a schematic cross-sectional view of a conventional single-phase cable without a neutral wire.
Figure 1B:
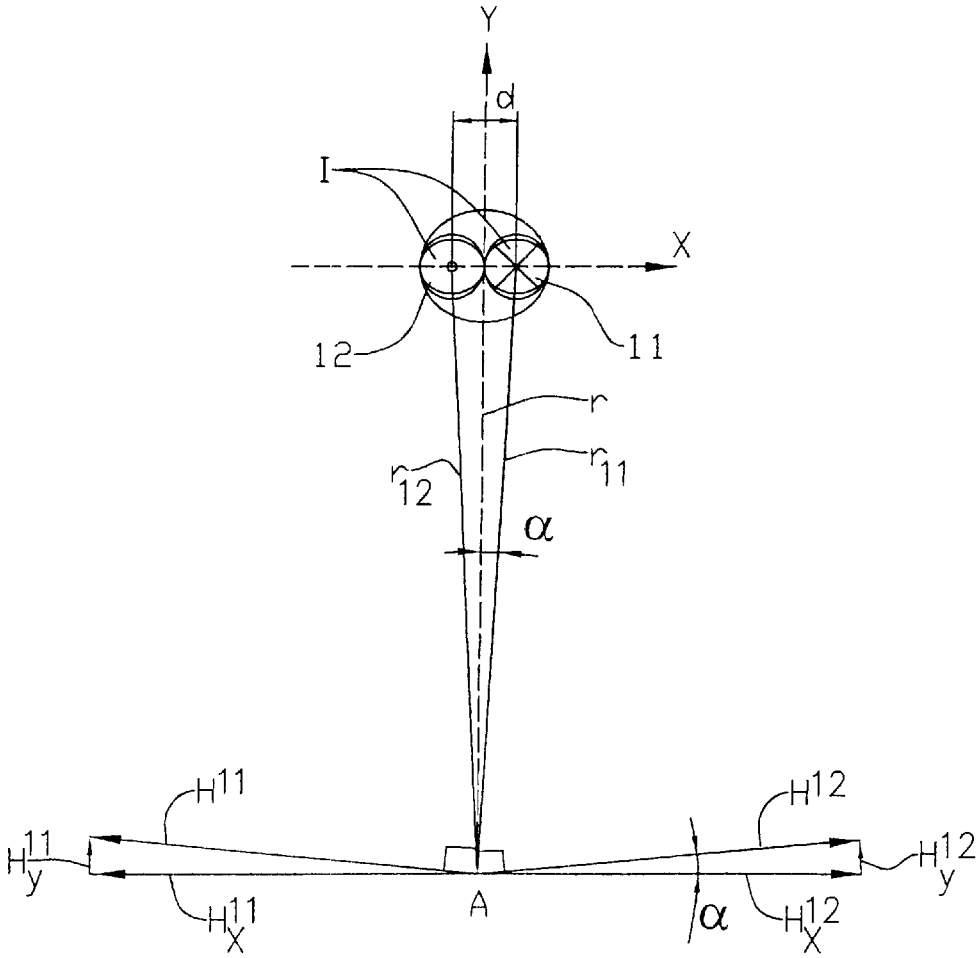
FIG. 1B PRIOR ART
FIG. 1*b* is a schematic diagram of superposition of magnetic field intensity vectors created by currents flowing in the cable shown in FIG. 1*a*.
Figure 2A:
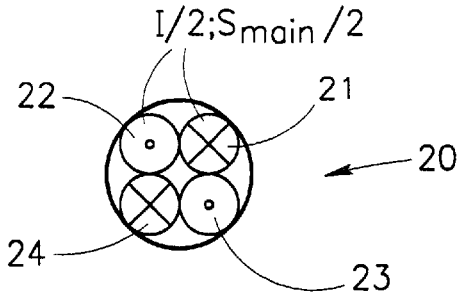
FIG. 2*a* is a schematic cross-sectional view of one embodiment of the inventive single phase cable.
Figure 2B:
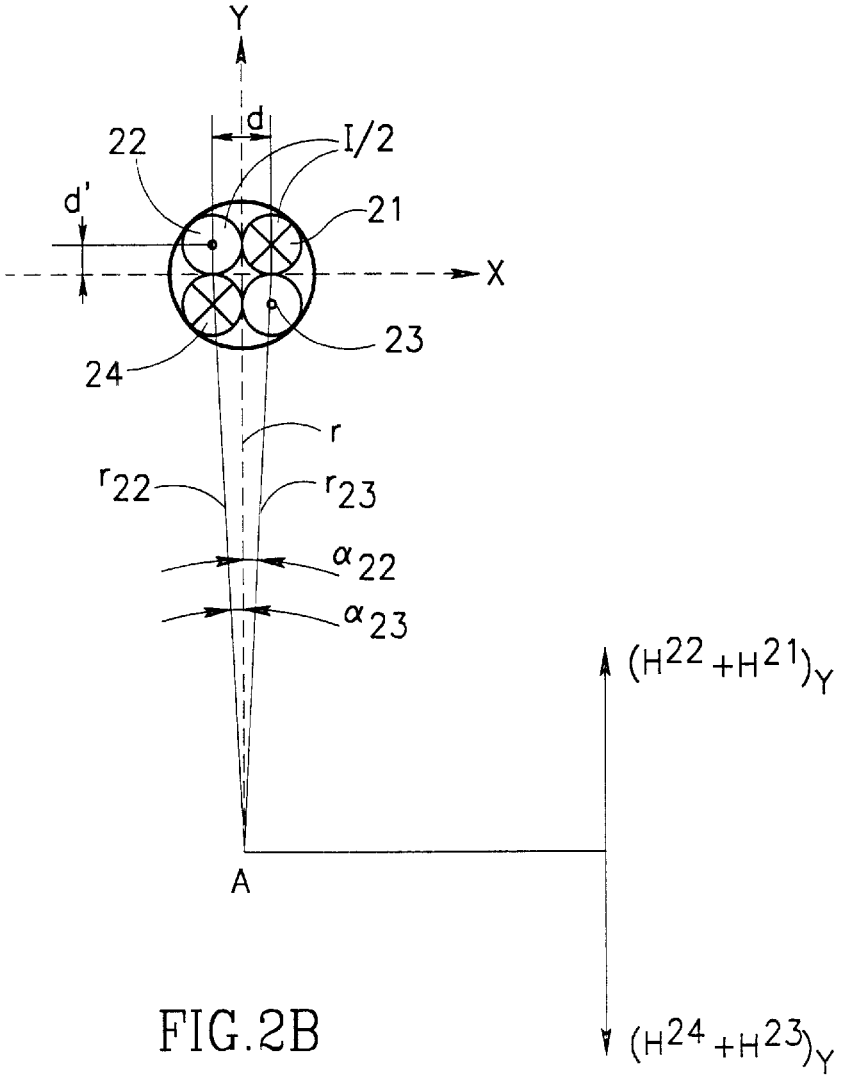
FIG. 2*b* is a schematic diagram of superposition of magnetic field intensity vectors created by the cable shown in FIG. 2*a*.

In order to explain the mechanism of attenuation of the external magnetic field in the vicinity of the invented cable, a simple numerical calculation will be performed for a conventional single phase cable with two wires (FIGS. 1*a* and 1*b*) and for an equivalent cable with four wires (FIGS. 2*a* and 2*b*). The magnetic field will be computed at two points: one being remote by 50 cm, and the other by 2 m from the center of the cable.

FIG. 1*a* refers to the Prior Art and illustrates a conventional single-phase cable 10 in its cross-section. The cable is comprised of two parallel insulated main conductors 11 and 12 each having a cross-section $S_{main}$, via which a single-phase current I passes in mutually opposite directions, as indicated in the drawing.

FIG. 1*b* illustrates a schematic vector diagram explaining a way to calculate intensity H of the magnetic field created by the cable 10 shown in FIG. 1*a* at the point A located at the distance r=50 cm from the center of the cable. The intensity $H_{total}$ is calculated according to the known method of superposition of the magnetic fields created by the two conductors 11 and 12 at the predetermined point. To this end, the following data and considerations will be utilized for the exemplary calculation:

radius of one conductor (including insulation) is 2 mm, so the distance between the centers of the conductors is 4 mm which corresponds to a single phase cable carrying current of about 30 A;

distance between each of the conductors and the point A is equal to:

$$r_{11}=r_{12}=\sqrt{50^2+0.2^2}\ \text{(cm)}$$

each conductor creates a vector of intensity $H_i$ (where i is 11 or 12), which can be divided into two component orthogonal vectors as follows:

$$H_{iy}H_i \sin\alpha \text{ and } H_{ix}=H_i \cos\alpha$$

intensity $H_i$ of the magnetic field created by one of the conductors at the point A (where distances $r_{11}=r_{12}$) can be calculated as follows:

$$H_i = \frac{I}{2\pi r_i}\ (A/\text{cm});$$

the two component vectors along axis x will compensate each other, and the total intensity of the magnetic field at the point A will be:

$$H_{total}=2H_y$$

After suitable calculations according to the above formulae and for the current I=30 A we obtain:

at a distance of 50 cm: $H_{total}=2{,}5462*I*10^{-5}$ (A/cm); ⇒ ⇒ $B_{total}=0.96$ mG;

at a distance of 2 m: ⇒ $B_{total}=6.0*10^{-2}$ mG;

FIG. 2*a* illustrates a schematic cross-section of one embodiment of the inventive single-phase cable 20, wherein each of two main conductors are assembled from a pair of sub-conductors having equal cross-sections, and any one of the sub-conductors is adjacent to those of the other main conductor. Sub-conductors 21 and 24 together carry the same total current I=30A in one direction; since these sub-conductors have equal cross-sections $S_{main}/2$, each of them carries a current I/2. The total cross-section of the main conductor formed by the sub-conductors 21 and 24 is equal to the cross-section of the conductor 11 (or 12) of the cable 10. The same applies to the sub-conductors 22 and 23 carrying the total current I in the opposite direction. From the functional point of view the cable 20 is completely equivalent to the cable 10 of FIG. 1*a*.

In order to check which external magnetic field will be created, for example, at point A located at a distance 50 cm from the center of the cable 20 (i.e. the same distance as in the example of FIG. 1*b*), the attention is drawn to FIG. 2*b*.

In order to be on the safe side, the same distance 4 mm between the wires (sub-conductors) will be maintained in the calculation, despite the fact that it could be decreased since the cross-section area of the wires became two times smaller. For the decreased distance between the wires, even a higher degree of attenuation could be obtained.

FIG. 2*b* illustrates a schematic vector diagram which shows superposition of magnetic fields created by the four sub-conductors shown in FIG. 2*a*. As in the former example, the sum of the x-components of the magnetic field created by a pair of wires 21, 22 and a pair of wires 23, 24 will be equal to zero. Therefore, only the y-components of the magnetic field remain, which can be written down as $(H^{21}+H^{22})_Y$ and $(H^{23}+H^{24})_Y$. These components are almost equal and since they are oppositely directed, their sum is very small:

$$H_{total}=|H^{21}+H^{22}|_Y+|H^{23}+H^{24}|_Y$$

Upon calculation of each of the four components of the above formula (the method of calculation is analogous to that effected for the conductors of conventional cable 10 above, but just for conductors with currents I/2 and radiuses being equal to the square root of 2), the following result has been obtained:

at a distance of 50 cm and for I/2=15A:

$$H_{total}=4.075*I/2*10^{-7}\ (\text{A/cm}),\ \Rightarrow B_{total}=7.7*10^{-3}\ \text{mG}.$$

The degree of the magnetic field attenuation with respect to the corresponding $B_{total}$ created by the conventional cable of FIG. 1 is equal to 125.

In an analogous way, at a distance of 2 m:

$$B_{total}=1.2*10^{-4}\ \text{mG}.$$

The degree of the magnetic field attenuation with respect to the corresponding $B_{total}$ created by the conventional cable of FIG. 1 is equal to 500.

It is readily seen that the magnetic field created by the inventive cable 20 is significantly weaker than that created by the conventional cable 10. Quantitatively, the degree of the magnetic field attenuation achieved by the embodiment of FIG. 2*a* is equal to 125 at a distance of 50 cm, which result is much better than the most effective screens known in the prior art. For longer distances the attenuation is even stronger.

Figure 3A:
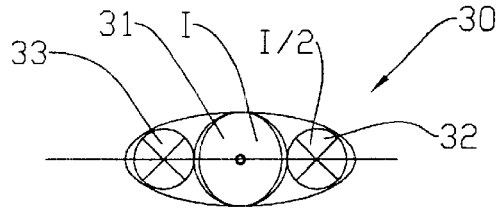
FIG. 3*a* is a schematic cross-sectional view of another embodiment of the single phase cable according to the invention.

FIG. 3*a* illustrates another simple modification of the inventive single-phase cable 30, which comprises one main conductor 31 similar to the conductor 12 in FIG. 1*a*, i.e. carries current I in one direction, and two sub-conductors 32 and 33 (placed at two diametrically opposite sides of the conductor 31) forming a second main conductor and carrying current I in the opposite direction. Each of the sub-conductors has a cross-section ($S_{main}/2$), where $S_{main}$ is the conductor's 31 cross-section, and carries a current equal to I/2. The attenuation degree of this embodiment will be about 126 at a distance of 50 cm, and 490 at a distance of 2 m.

Figure 3B:
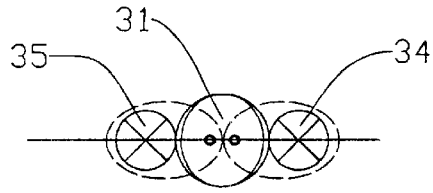
FIG. 3*b* schematically shows how the inventive cable can be represented as a system of dipoles.

FIG. 3*b* illustrates how the embodiment of FIG. 3*a* can be schematically represented as two dipoles according to the definition given in the Summary of the Invention (a so-called quadrupole configuration) which are shown by the dotted contours 34 and 35. Each one of the dipoles includes two equal and oppositely directed currents; the current I passing through the main conductor 31 is represented as a pair of two unidirectional currents I/2. It is understood, that the two dipoles 34 and 35 have magnetic moments ($M=\mu_0*\bar{I}/2*D*l_0*\bar{n}_0$) which are equal and oppositely directed. According to the invention, such a construction satisfies the so-called condition of "a number of dipoles" described in the Summary of the Invention, and therefore enables to reduce significantly the external magnetic field. It should be mentioned, that the embodiment of FIG. 2*b* also satisfies the condition, since two pairs of dipoles can be formed from the currents passing via the four sub-conductors.

Figure 4:
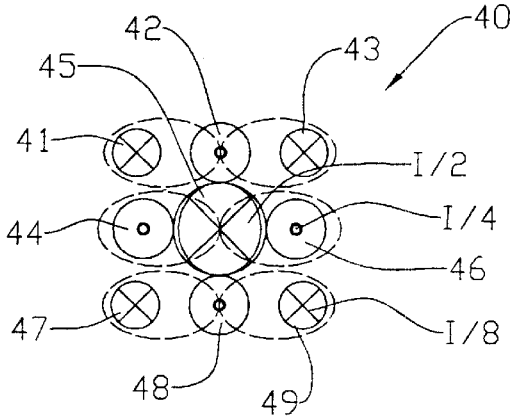
FIG. 4 is a schematic cross-sectional view of yet another embodiment of the single-phase cable according to the invention.

FIG. 4 schematically illustrates yet another embodiment 40 of a single phase cable, having five sub-conductors of one type (41, 43, 45, 47, and 49) and four sub-conductors of another type (42, 44, 46, 48), mixed in the cable. The sub-conductor 45 carries a current I/2 and has cross-section $S_{main}/2$, while the sub-conductors 41,43,47 and 49 have cross-sections $S_{main}/8$ and transmit currents I/8, respectively. All four conductors 42, 44, 46 and 48 have cross-sections equal $S_{main}/4$ and carry currents I/4, respectively. Three pairs of dipoles are formed in this modification (shown by dotted lines). It has been proven that the degree of the magnetic field attenuation, achieved by this embodiment of the inventive cable at a distance of 50 cm from the center of the cable (with reference to the conventional cable of FIG. 1*a*), is about $1.054*10^7$, i.e. more than ten million (!). At a distance of 2 m the degree of attenuation is even more, i.e. $6.67*10^8$.

Figure 5:
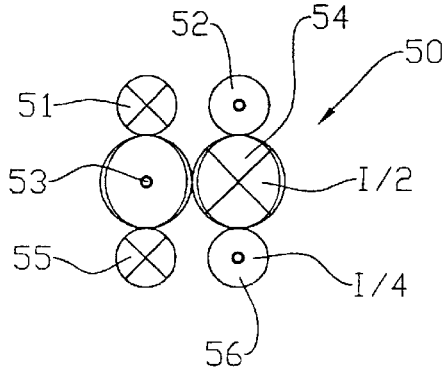
FIG. 5 is a schematic cross-sectional view of still a further embodiment of the single-phase cable according to the invention.

FIG. 5 demonstrates another arrangement 50 of a single-phase cable, wherein each of sub-conductors 53 and 54 has the cross-section $S_{main}/2$ and transmits current I/2, while sub-conductors 51, 52, 55, 56 have the cross-section $S_{main}/4$ and carry currents I/4, respectively. Two pairs of dipoles are formed in this embodiment and the degree of the magnetic field attenuation at a distance of 50 cm appears to be equal 42,000, i.e. it is lower than that of the embodiment in FIG. 4 (three pairs of dipoles), though it is much higher than that of FIG. 2*a* (one pair of dipoles). At a distance of 2 m the attenuation degree will be about 667,000.

Figure 6:
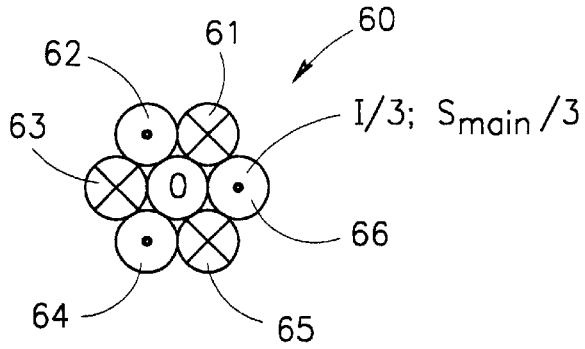
FIG. 6 is an embodiment of the inventive single-phase cable with a neutral conductor, shown in cross-section with n=3.

FIG. 6 illustrates an arrangement 60 of sub-conductors in a single-phase cable with a zero wire. Each main conductor is assembled from three sub-conductors, and the sub-conductors of two types alternate with one another, surrounding the zero wire. It has been calculated that the attenuation degree of this embodiment at a distance of 50 cm is about 63,400. At a distance of 2 m the degree is about 985,000. The cable 60 can also be used as a three-phase cable with two parallel sub-conductors for each phase (61 and 64 for one phase, 62, 65 for the second phase, and 63, 66 for the third phase). The attenuation degree of such a three-phase cable will be about 65. See also FIGS. 9 and 10 below.

Figure 7:
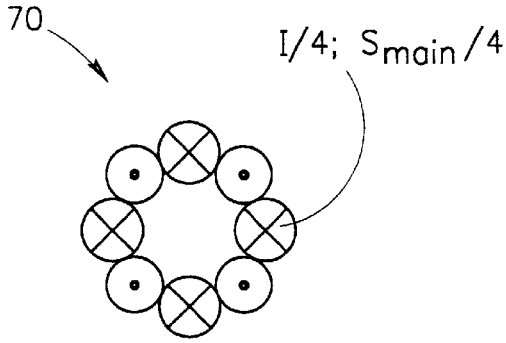
FIG. 7 is a modification of the embodiment shown in FIG. 6, wherein (n=4), without a neutral conductor.

FIG. 7 shows an embodiment 70 similar to that in FIG. 6 and having the attenuation degree of about $65*10^6$ at a distance of 50 cm, and $41.67*10^8$ at a distance of 2 m.

It should be mentioned that all the described single-phase cables were designed for the same current of 30 A and for a constant current density.

Figure 8:
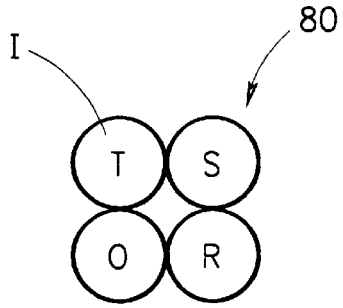
FIG.8 PRIOR ART
FIG. 8 (prior art) is a schematic cross-sectional view of a conventional three phase cable.

FIG. 8 illustrates a cross-section of a conventional three phase cable 80 which can be referred to as Prior Art. The cable includes three main single-phase conductors S, R and T. An optional neutral wire (zero-wire) 0 is shown with a dotted line. In this three phase cable the diameter of each insulated phase conductor is 20 mm, so the distance between the conductors is also about 20 mm. Such a three phase cable is suitable for a phase current of about 240 A. The magnetic induction created by the conventional cable 80 at a distance of 50 cm from its center is B=55 mG. At a distance of 2 m from the center of the cable the induction is of about B=3,4 mG.

Figure 9:
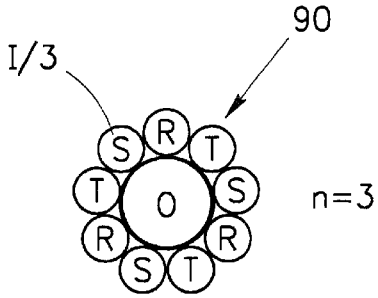
FIG. 9 is a schematic cross-sectional view of one embodiment of a three phase cable according to the invention, where n=3.

FIG. 9 illustrates an embodiment 90 of a multi-phase inventive cable, where each of the phase conductors is assembled from three sub-conductors (i.e. n=3) marked with one and the same letter. The sub-conductors of three different phases alternate with each other and surround the zero-wire. The angle $\alpha$ between each two sub-conductors is about 360°/(3*3)=40, and an angle $\beta$ between each two sub-conductors belonging to the same phase is about 360°/3=120. The attenuation degree of this embodiment at the distance 50 cm is about 209, and at a distance of 2 m it will be about 448.

Figure 10:
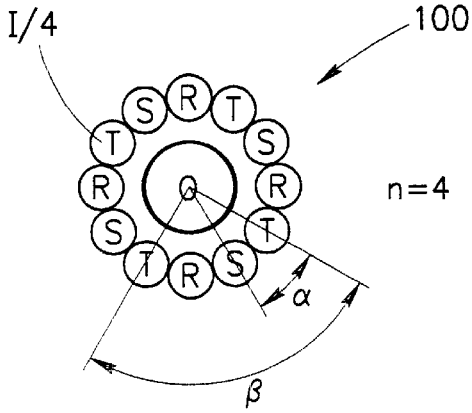
FIG. 10 is another embodiment of the inventive three phase cable, shown in cross-section, where n=4.

FIG. 10 illustrates another embodiment 100, being a modification of that shown in FIG. 9. In the embodiment 100 each single-phase conductor is divided into four sub-conductors (n=4). The attenuation degree at a distance of 50 cm is about 4,600, and at a distance of 2 m it is about 71,600.

Figure 11:
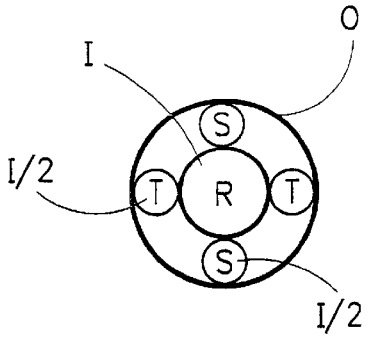
FIG. 11 is yet another embodiment of a three phase cable having split and non-split phase conductors.

FIG. 11 illustrates a further embodiment of a three phase cable with a coaxial zero wire 0 and three phase conductors. One phase conductor R conducts current I=240 A. Two conductors S and T are divided into pairs of sub-conductors S1, S2 and T1, T2 respectively, and each of the sub-conductors carries current being I/2. The sub-conductors are symmetrically arranged around the phase conductor R placed in the center of the cable. The attenuation degree of this cable with respect to that shown in FIG. 8 is about 26 at a distance of 50 cm, and about 102 at a distance of 2 m.

Figure 12:
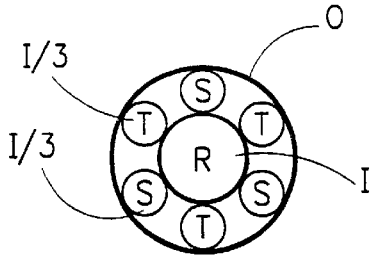
FIG. 12 is a modified embodiment of FIG. 11.

FIG. 12 shows a slightly modified embodiment, where each of the phase conductors S and T is divided into three equal sub-conductors uniformly distributed around the non-divided conductor R. The attenuation degree provided by this embodiment is about 830 at a distance of 50 cm, and 13,200 at a distance of 2 m.

Figure 13:
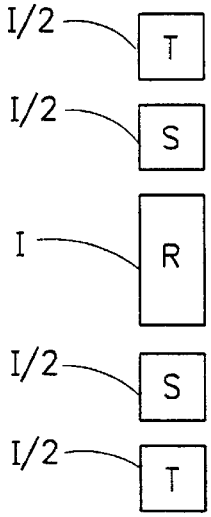
FIG. 13 is an embodiment of a three phase cable having conductors and sub-conductors having square-like cross-sections.

FIG. 13 shows an embodiment of a three phase cable having conductors and sub-conductors non-circular in their cross-section, the number thereof being similar to the arrangement in FIG. 11. The attenuation degree for the cable shown in this drawing is slightly smaller than that calculated for the cable of FIG. 11, i.e. it is about 25 at a distance of 50 cm and 90 at a distance of 2 m.

Figure 14:
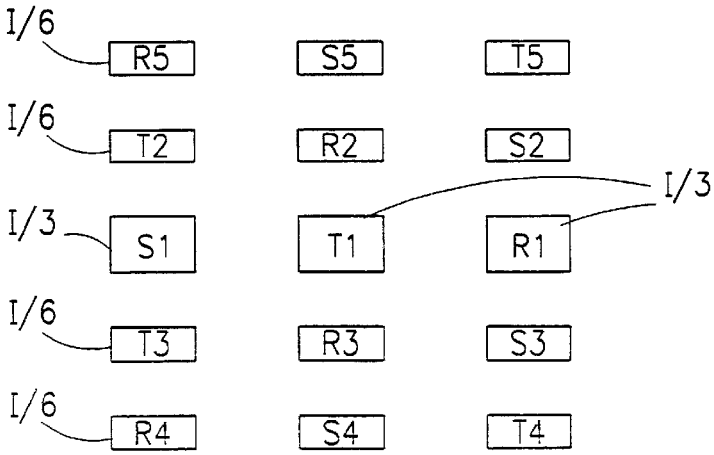
FIG. 14 is a modification of the embodiment shown in FIG. 13.

FIG. 14 illustrates a more complex embodiment of the three phase cable assembled from non-circular wires (the total number of sub-conductors is 15). At 50 cm from the center of the cable the embodiment provides a degree of attenuation of the magnetic field equal to 1209, and at 2 m from the center of the cable,—a degree of about 19,200.

It should be emphasized that though in FIGS. 11 to 13 the non-divided conductor is marked to belong to phase R, it might belong as well to either phase S or phase T.

All values of the attenuation degree are given in comparison with:

- a conventional single phase cable described with reference to FIGS. 1*a* and 1*b* (for embodiments of the inventive single phase cable shown in FIGS. 2 to 7); and/or
- a conventional three phase cable described with reference to FIG. 8 (for inventive embodiments of FIGS. 9 to 14).

Similarly to the case of single phase cables, all the above-described three phase cables were designed for the same phase current of 240 A and for a constant current density value.

As has already been mentioned, the inventive cables have lower self-inductance, and lower mutual inductance than the respective conventional single phase and three phase cables.

For single phase cables the following results have been obtained. Self-inductance of a single phase cable $L_{phase,\ Fig.No}$ has been computed for each of the cables shown in the following drawings:

- $L_{11}$—is self-inductance of a single-phase cable shown in FIG. 1*a* (the conventional single phase cable);
- $L_{12}$—is self-inductance of a new single-phase cable shown in FIG. 2*a;*
- $L_{16}$—is self-inductance of a new single-phase cable shown in FIG. 6;
- $L_{17}$—is self-inductance of a new single-phase cable shown in FIG. 7.

Then, three ratios were calculated, each one showing how the self-inductance of one of the inventive single phase cables is reduced in comparison with that of the conventional single phase cable:

$$L_{12}/L_{11}=0.316;\ L_{16}/L_{11}=0.261;\ L_{17}/L_{11}=0.202.$$

Also, mutual inductance $M_{Fig.No.(first\ cable):FigNo.(second\ cable)}$ was computed for the following four pairs of cables at a constant distance from the inventive (new) cable:

- $M_{11}$—is mutual inductance between two conventional single-phase cables shown in FIG. 1*a;*
- $M_{12}$—is mutual inductance between the new single phase cable shown in FIG. 2*a* and the conventional single-phase cable shown in FIG. 1*a*.
- $M_{16}$—is mutual inductance between the new single-phase cable shown in FIG. 6 and the conventional single-phase cable shown in FIG. 1*a*.
- $M_{17}$—is mutual inductance between the new single-phase cable shown in FIG. 7 and the conventional single-phase cable shown in FIG. 1*a*.

Further, the following ratios were obtained to show how the mutual inductance, created in arrangements where the new cables participate, decreased in comparison with that created between the conventional cables:

$$M_{12}/M_{11}=0.0261;\ M_{16}/M_{11}=0.00864;\ M_{17}/M_{11}=0.00540.$$

For the case of three phase cables, the self-inductance and the mutual inductance were calculated and written down in a similar way:

- $L_{3,8}$—is self-inductance of the conventional three phase cable shown in FIG. 8.
- $L_{3,6}$—is self-inductance of a new three phase cable according to the arrangement shown in FIG. 6;
- $L_{3,9}$—is self-inductance of a new three phase cable shown in FIG. 9;
- $L_{3,10}$—is self-inductance of a new three phase cable shown in FIG. 10.

The ratios between the self-inductances are as follows:

$$L_{3,6}/L_{3,8}=0.490;\ L_{3,9}/L_{3,8}=0.341;\ L_{3,10}/L_{3,8}=0.257.$$

Mutual inductances $M_{3,6}$, $M_{3,8}$, $M_{3,9}$, $M_{3,10}$ for each of the above-mentioned three phase cables were calculated similarly to the case of single phase cables, where the first (reference) cable in each respective pair is a single phase conventional cable shown in FIG. 1*a*. In other words, the mutual inductance for each of the pairs including the above three phase cable was computed for an external magnetic field induced by a single phase cable, and at a constant distance from the investigated cables.

The ratios between the obtained mutual inductances show that three phase cables having more sub-conductors create lower mutual inductance with external magnetic field. Since the mutual inductance for a three phase cable is different for its different phases, the ratios were computed for average values:

$$M_{3,6}/M_{3,8}=0.260;\ M_{3,9}/M_{3,8}=0.0766;\ M_{3,10}/M_{3,8}=0.0402.$$

The obtained results indicate a clear advantage of the inventive cables over the conventionally used cables.

What is claimed is:

1. A method of designing a single-phase electric cable comprising insulated conductors for conducting currents in different directions, each conductor having a design cross-section area and given current to pass therethrough, said cable providing a predetermined minimal strength of the external magnetic field by ensuring a predetermined degree of attenuation defined in comparison to the external magnetic field of a conventional cable carrying the same current, the method comprising the following steps:

(a) assembling at least one of said conductors from a plurality of n subconductors to be connected in parallel, wherein the sum of cross-sectional areas of the subconductors is equal to the design cross-section area of said at least one conductor;

(b) arranging said conductors and said subconductors in the cable in such a manner that each of said subconductors is adjacent to at least one of said conductors or said subconductors carrying current of opposite direction;

(c) placing all said conductors and said subconductors as close as possible to one another;

(d) arranging magnetic dipoles from currents passing via all said sub-conductors and conductors, determining value and direction of magnetic moment of each of said magnetic dipoles, and adjusting the arrangement of said conductors and sub-conductors in such a manner that the sum of the magnetic moments is:

$$\sum_{i=1}^{N} M_i = 0$$

where N is the total number of said magnetic dipoles;

(e) estimating the external magnetic field and adjusting the degree of attenuation thereof by selecting the number n of subconductors for assembling said at least one conductor.

2. A method in accordance with claim 1, wherein the degree of attenuation is at least about 125 at 0.5 m from cable's center and at least about 500 at 2 m from cable's center.

3. A method in accordance with claim 1, wherein the step (d) includes adjustment of said conductors and subconductors in such a manner that a number of groups of magnetic dipoles is formed, the sum of magnetic moments of the magnetic dipoles for each such group being zero.

4. A single-phase electric cable providing a degree of attenuation at least about 125 at 0.5 m from cable's center and at least about 500 at 2 m from cable's center, designed in accordance with the method of one of claims 1 and 3.

5. A single-phase electric cable according to claim 4, wherein n>3.

6. A single-phase electric cable according to claim 4, wherein one conductor thereof is assembled from two subconductors which are symmetrically placed near a non-split conductor from its two diametrically opposite sides.

7. A method of designing a multiphase electric cable with m phases comprising insulated phase conductors for conducting currents of different phases and a neutral conductor, each conductor having a design cross-section area and given current to pass therethrough, said cable providing a predetermined minimal strength of the external magnetic field by ensuring a predetermined degree of attenuation defined in comparison to the external magnetic field of a conventional cable carrying the same current, the method comprising the following steps:

(a) assembling at least one of said phase conductors from a plurality of n phase subconductors to be connected in parallel, wherein the sum of cross-sectional areas of said phase subconductors is equal to the design cross-section area of said at least one phase conductor;

(b) arranging all the conductors and the subconductors in the cable in such a manner that each of the subconductors is adjacent to at least one of the conductors or the subconductors carrying current either of different phase or opposite direction;

(c) placing all conductors and subconductors as close as possible to one another;

(d) determining magnetic dipoles formed in each of the phase conductors or subconductors of the multiphase cable and the neutral conductor, and adjusting the arrangement of the conductors and sub-conductors in such a manner that magnetic moments of said magnetic dipoles satisfy a system of equations wherein each said equation is built for each of the phases of the cable:

$$\sum_{n=1}^{N} M_{Rn} = 0$$

$$\sum_{p=1}^{P} M_{Sp} = 0$$

$$\ldots$$

$$\sum_{q=1}^{Q} M_{Tq} = 0$$

where R,S, . . . T—are conductors of different phases of a multiphase cable; N, P, . . . Q—are total numbers of sub-conductors in each of the phase conductors R, S, . . . T, respectively; n, p, . . . q—symbolize each a specific number of a sub-conductor in the phase conductors R, S, . . . T, respectively; $M_{Tq}$—is a particular magnetic moment created by a current passing in a sub-conductor q of the phase conductor T and a corresponding current in the neutral conductor; and (e) estimating the external magnetic field and adjusting the degree of attenuation thereof by selecting the number n of subconductors for assembling said at least one conductor.

8. A method in accordance with claim 7, wherein at least two phase conductors are assembled from phase subconductors, and the degree of attenuation is at least about 25 at 0.5 m from cable's center and at least about 90 at 2 m from cable's center.

9. A method according to claim 7, wherein the step (d) additionally comprises checking whether the magnetic flux density in the center of the cable is essentially equal to zero, and using it as a criterion for correct designing of the cable.

10. A method in accordance with claim 7, including a step of assembling each of the m phase conductors of the cable from n equal sub-conductors, and the step of arranging said sub-conductors in a circle, so that an angle α between each two adjacent sub-conductors is 360°/m*n, and an angle β between each two nearest sub-conductors belonging to the same phase is 360°/n.

11. A multiphase cable providing a degree of attenuation at least about 25 at 0.5 m from cable's center and at least about 90 at 2 m from cable's center designed in accordance with the method of claim 7.

12. A multiphase cable according to claim 11, having m phase conductors each assembled from n>2 equal subconductors arranged in a circle so that an angle α between each two of said sub-conductors adjacent to each other is 360°/m*n, and an angle β between each two nearest of said sub-conductors belonging to the same phase is 360°/n.

13. A multiphase cable according to claim 11, comprising a non-split phase conductor positioned at the center of the cable, and further comprising at least one phase conductor assembled from two or more insulated sub-conductors, said sub-conductors surrounding said non-split phase conductor.

14. A multiphase cable according to claim 11, comprising a number of phase conductors, at least one of which is assembled from three or more insulated sub-conductors.

15. A multiphase cable according to claim 11, wherein at least one conductor or sub-conductor has non-circular cross-section.

16. A multiphase cable according to claim 11, wherein the neutral conductor is formed as a round sleeve housing the phase conductors and subconductors.

17. A multiphase cable according to claim 11, designed for symmetrical load, wherein the design current in the neutral conductor and, consequently, the neutral conductor is absent.

18. A method of connecting an electric cable comprising a plurality of insulated conductors disposed in a given configuration in the cross-section of the cable, for conducting given single-phase or multiphase current with attenuated external magnetic field, by connecting said conductors in parallel, in phase groups, one group for each cable phase and one for zero-wire, in such a manner that:

(a) a number n of said conductors, of at least one of said phase groups, are each adjacent to one or more of all the conductors carrying current either of different phase or of opposite direction;

(b) a total sum of magnetic moments of magnetic dipoles is minimized for each of said phase groups separately, said magnetic dipoles being formed from equal and opposite currents in each of said conductors of said phase groups and the zero-wire;

(c) there is achieved a degree of attenuation at least about 125 at 0.5 m from cable's center and at least about 500 at 2 m from cable's center for a single-phase cable, and at least about 25 at 0.5 m from cable's center and at least about 90 at 2 m from cable's center for a multiphase cable, said degree of attenuation being defined in comparison to the external magnetic field of a conventional cable carrying the same current, (d) if the degree of attenuation in (c) is not achieved, the number n and/or the number of phase groups in step (a) is increased, as far as said given configuration of the cable allows.

19. A method of connecting an electric cable according to claim 18, wherein the configuration of the cable allows to achieve such connections that at least for one phase group the sum of magnetic moments is $$\sum_{i=1}^{N} M_i = 0$$

20. A method of connecting an electric cable according to claim 19, wherein the configuration of the conductors in the cable is symmetric.

21. A method of connecting an electric cable according to claim 20, wherein the conductors of at least one of said phase groups are divided in a number of subgroups, the sum of magnetic moments of magnetic dipoles formed for each such subgroup being zero.

* * * * *